US008735706B2

(12) United States Patent
Mathews

(10) Patent No.: US 8,735,706 B2
(45) Date of Patent: May 27, 2014

(54) MUSICAL INSTRUMENT KEYBOARD HAVING IDENTICALLY SHAPED BLACK AND WHITE KEYS

(76) Inventor: Sydney Mathews, Ottawa (CA)

( * ) Notice: Subject to any disclaimer, the term of this patent is extended or adjusted under 35 U.S.C. 154(b) by 145 days.

(21) Appl. No.: 12/782,876

(22) Filed: May 19, 2010

(65) Prior Publication Data

US 2011/0283864 A1 Nov. 24, 2011

(51) Int. Cl.
*G10C 3/12* (2006.01)

(52) U.S. Cl.
USPC ..... 84/423 R; 84/433; 84/423 A

(58) Field of Classification Search
USPC ..... 84/423 R
See application file for complete search history.

(56) References Cited

U.S. PATENT DOCUMENTS 3,342,094 A 9/1967 Wilson
3,610,800 A * 10/1971 Deutsch ..... 84/619
4,031,800 A 6/1977 Thompson
4,640,173 A * 2/1987 Coles ..... 84/657
4,777,856 A 10/1988 Liu et al.
4,926,734 A 5/1990 Rickey
5,440,071 A 8/1995 Johnson
5,549,029 A 8/1996 Lepinski
6,005,178 A 12/1999 Osuga et al.
6,020,549 A 2/2000 Reimann et al.
6,259,006 B1 7/2001 Parienti
6,566,593 B2 * 5/2003 Pertchik ..... 84/423 R
6,605,767 B2 * 8/2003 Fiks et al. ..... 84/423 R
7,439,438 B2 10/2008 Hao
7,465,868 B2 * 12/2008 Lengeling ..... 84/719
7,619,154 B2 11/2009 Hammond
2007/0289431 A1 * 12/2007 Hammond ..... 84/433
2010/0077905 A1 4/2010 Hammond

* cited by examiner

*Primary Examiner* — Christopher Uhlir
(74) *Attorney, Agent, or Firm* — Greer, Burns & Crain, Ltd.

(57) ABSTRACT

A musical instrument keyboard is provided comprising a plurality of black and white keys being identically shaped and sized and arranged on a single plane in a parallel and fully adjacent manner relative to one another said keys being connected to key responsive means for enabling the generation of tones substantially within the tonal range of a standard piano.

10 Claims, 1 Drawing Sheet

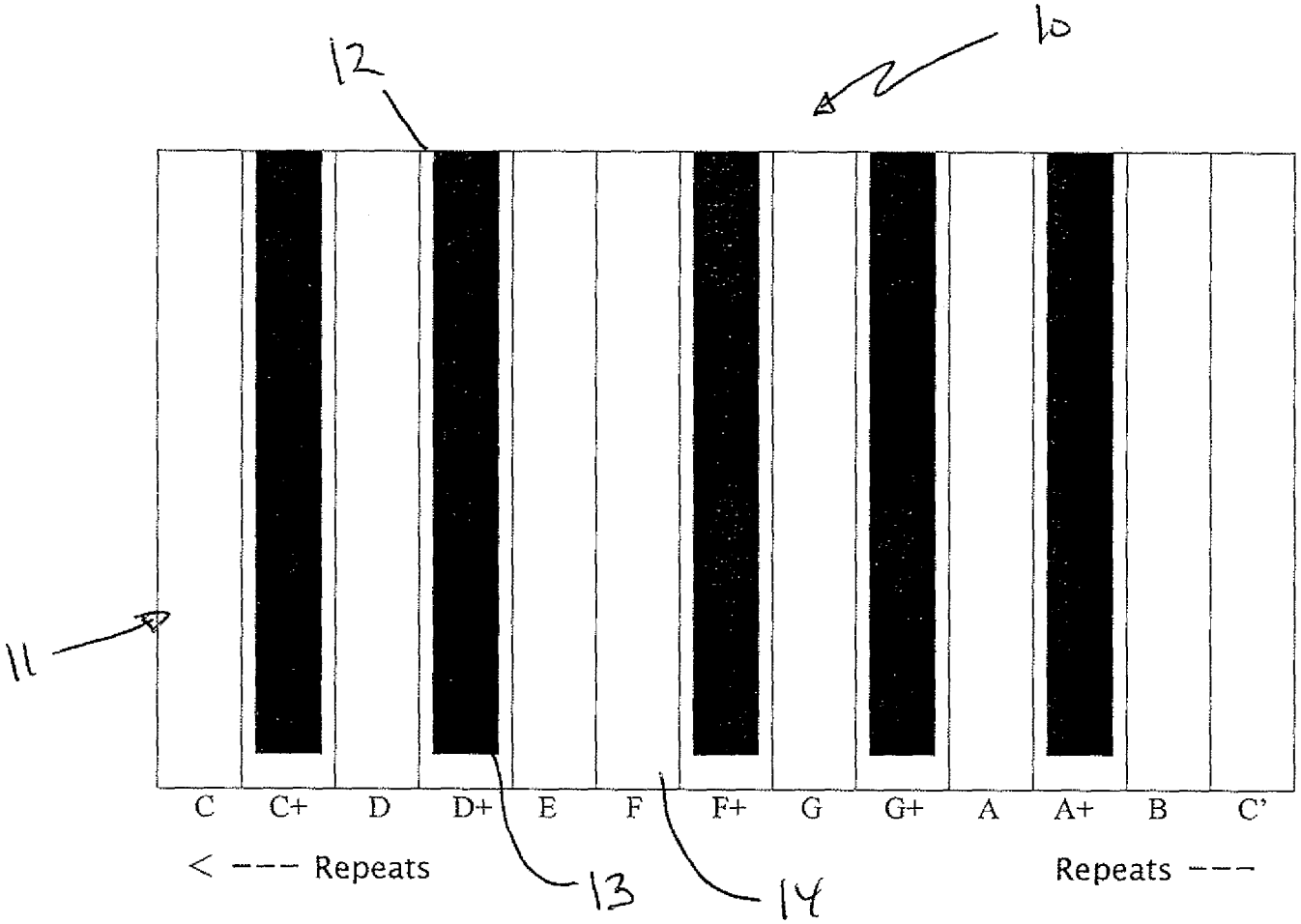
C
C+
D
D+
E
F
F+
G
G+
A
A+
B
C'
< --- Repeats
Repeats ---
10
11
12
13
14

MUSICAL INSTRUMENT KEYBOARD HAVING IDENTICALLY SHAPED BLACK AND WHITE KEYS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

FIELD OF INVENTION

The present invention relates generally to keyboard type musical instruments and more particularly relates to keyboard configurations directed to and offering unified fingering and as a result ergonomic optimization with regard to the human hand.

BACKGROUND

The prior art broadly includes the standard piano keyboard configuration developed centuries ago which has become accepted as a practical compromise to the complex problem of interfacing the human hand to a music making device.

The musician faces some disadvantages but the main advantages of relative simplicity, universal acceptance, standardization and mass-producibility have made it to date the de facto standard.

A key disadvantage is the narrow separation currently existing between the black keys for playing the white keys which may pose serious problems for those musicians having large fingers. It is further noted that because of the major differences between black and white keys be it in size, shape, elevation, positioning or distance, it follows that the human hand must be contorted to access different keys thereby making piano playing technique complex.

There exists three main key playing areas being the full width portion of the white keys, the narrow portion of the white keys between the black keys, and finally the black keys themselves. As a result, each hand digit will relate differently to each one of these areas. For instance, using the thumb or small finger for playing/accessing black keys might require a twisting of the wrist. Since different areas present different playing axis, the fingers must be trained to compensate for different touch due to differences in distance from the key pivot, leverage, relative key mass location, dynamics etc. All of this requires a great deal of arm, hand and finger movement leading to fatigue and pain.

Some prior art known to the applicant is found in U.S. Pat. Nos. 5,440,071; 4,926,734; 3,342,094 and 4,031,800. U.S. Pat. No. 5,440,071 would appear to propose the closest device to the applicant's proposed structure disclosed hereinafter in that it offers keys of similar size and shape to the traditional piano-style key, yet there are no black keys in between the white keys.

SUMMARY

The present invention overcomes the above referred to difficulties and problems in a convenient, simple and efficient manner.

Accordingly, it is a primary object of the present invention to provide an ergonomically adapted keyboard overcoming the above mentioned disadvantages of the prior art.

Another object of the present invention is to provide a unified fingering system.

Yet another object of the present invention is to provide a musical instrument keyboard comprising a plurality of black and white keys, and key responsive means for enabling the generation of tones associated to said keys, respectively, said keys being identically shaped and sized and arranged on a single plane in a parallel and fully adjacent manner relative to one another. Other objects and advantages will be described hereinafter.

BRIEF DESCRIPTION OF THE DRAWINGS

FIG. 1 is a plan view of the keys of a keyboard in accordance with the present invention.

DETAILED DESCRIPTION

By way of technical background, when playing the notes of musical scales (major, minor) on a keyboard, the mix of black and white keys, for each scale, depends on the key in which the music is played. Similarly when playing various chords (major, minor, augmented, diminished etc.), the mix of black and white notes, for any one type of chord, varies with the keyboard tonic note for the chord.

As earlier discussed, having to change the mix of black and white keyboard notes for the same basic pattern of uniquely defined solfege notes and chords involves using complicated different fingering for the two tiered black and white levels of regular keyboards.

For the keyboard of the present invention the finger 'set' in each hand does not change with the circumstances, as described above for the regular keyboard, since all the keys are on the same level.

As a result, the keyboard of the present invention can be played with much less complication and in a more comfortable fashion than a regular keyboard.

Two examples are given of the mix changes between black and white notes for the same musical chord: 1) KEY of C and/or Tonic C for chords.

| | C | C+ | D | D+ | E | F | F+ | G | G+ | A | A+ | B | C' |
|---|---|---|---|---|---|---|---|---|---|---|---|---|---|
| N | 0 | 1 | 2 | 3 | 4 | 5 | 6 | 7 | 8 | 9 | 10 | 11 | 12 |
| Voice | Do | Di | Ra | Re | Me | Fa | Fi | So | Si | La | Li | Ti | Do' |

The major scale keyboard notes are: C D E F G A B C (No black notes)
The major chord notes are: C E G (No black notes)

KEY of D+ and/or Tonic D+ for chords

| | D+ | E | F | F+ | G | G+ | A | A+ | B | C' | C'+ | D' | D'+ |
|---|---|---|---|---|---|---|---|---|---|---|---|---|---|
| N | 0 | 1 | 2 | 3 | 4 | 5 | 6 | 7 | 8 | 9 | 10 | 11 | 12 |
| Voice | D | Di | Ra | Re | Me | Fa | Fi | So | Si | La | Li | Ti | Do' |

The major scale keyboard notes are: D+ F G G+ A+ C' D' D'+ (Four black notes)
The major chord notes are: D+ G A+ (Two black notes)

It is also noted that standard keyboard players would immediately be able to play the keyboard of the present invention with no change required in their playing techniques.

The keyboard retains all the traditional features used on standard keyboards except for the fact that its keys are all of the same size and have the same shape.

Keyboards produce sounds by activating vibrations in various ways: Striking tensioned steel strings in pianos, blowing air through reeds in accordions and electronically controlled membranes in electronic keyboards.

To assist in describing the advantages of the keyboard of the present invention, the musical theory subjects of scales, chords and the Keys for playing music are examined.

For this the concept of two sequences of notes are used. These sequences are in the form of chromatic scales where the sound frequencies associated with the notes are such that the ratio of the frequency of sound of each note to that of the preceding note is: $2^{(1/12)}$ The first sequence of key notes considered is the fixed musical scale on the keyboard.

The second sequence of notes considered is a notional moveable 'solfege' scale used in composing, writing and playing music.

Music in Western Countries is mostly centered on major scales. The major scale notes on the keyboard associated with any playing key and the notes for any type of chord can be determined by superposing the 'solfege' scale over the keyboard scale.

The Fixed Keyboard Scale

This is a chromatic scale. The black notes used on standard keyboards are retained as this enables instant recognition of the keys. The keys are also tuned to the standard frequencies. In a detailed design of an H keyboard there is no requirement for the key surfaces to be flat. The surfaces could be, for example, triangular or semi circular cross sectioned cylinders along their lengths. The number of 'octaves' covered can be typically four for small keyboards up to seven plus for pianos or larger keyboards.

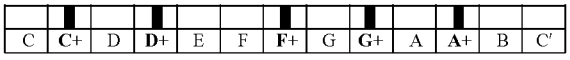

The Moveable Solfege Scale

| N | 0 | 1 | 2 | 3 | 4 | 5 | 6 | 7 | 8 | 9 | 10 | 11 | 12 |
|---|---|---|---|---|---|---|---|---|---|---|---|---|---|
| Voice | Do | Di | Ra | Re | Me | Fa | Fi | So | Si | La | Li | Ti | Do' |

N is a chromatic scale number.
The ratio of the sound frequency for any note (N) to that of the tonic (0, Do) is: $2^{(N/12)}$.
The major scale notes are: (0, Do) (2, Ra) (4, Me) (5, Fa) (7, So) (9, La) (11, Ti) (12, Do')
The minor scale notes are: (0, Do) (2, Ra) (3, Re) (5, Fa) (6, Fi) (9, La) (11, Ti) (12, Do')
The major chord is: (0, Do) (4, Me) (7, So) (12, Do')
The minor chord is: (0, Do) (3, Re) (6, Fi) (12, Do')
Other chords can be defined in a similar way.

Keyboard key notes for the scales and the keyboard notes for any chord in any key can be determined by superposing the 'solfege' scale over the fixed keyboard scale.

Various Musical Scales and Chords as Used in Western Countries

| | | Solfege Scales, Chromatic Numbers N | | | | | | | | | | | | |
|---|---|---|---|---|---|---|---|---|---|---|---|---|---|---|
| Scale | | Do | Di | Re | Ri | Mi | Fa | Fi | So | Si | La | Li | Ti | Do |
| Chromatic | | 0 | 1 | 2 | 3 | 4 | 5 | 6 | 7 | 8 | 9 | 10 | 11 | 0' |
| Diatonic | | 0 | | 2 | | 4 | 5 | | 7 | | 9 | | 11 | 0' |
| Minor | | 0 | | 2 | 3 | | 5 | | 7 | | 9 | | 11 | 0' |
| Harmonic Minor | | 0 | | 2 | 3 | | 5 | | 7 | 8 | | | 11 | 0' |
| Solfege | Traditional Name | Solfege Chords, Chromatic Numbers N | | | | | | | | | | | | |
| Maj | Maj | 0 | | | | 4 | | | 7 | | | | | 0' |
| Maj− | Maj− | 0 | | | 3 | | | 6 | | | | | | 0' |
| Maj+ | Maj+ | 0 | | | | 4 | | | | 8 | | | | 0' |
| Maj 9 | Maj 6 | 0 | | | | 4 | | | 7 | | 9 | | | |
| Maj 10 | Maj 7 | 0 | | | | 4 | | | 7 | | | | 11 | |
| Min | Min | 0 | | | 3 | | | | 7 | | | | | 0' |
| Min 9 | Min 6 | 0 | | | 3 | | | | | 8 | | | | |
| Min 11 | Min 7 | 0 | | | 3 | | | | | | | 10 | | 0' |

The instrument keys for any scale or chord can be determined by superposing a scale of instrument keys over the solfege scales above.

Example 1

Minor Scale Instrument Keys, KEY of A?

| | A | A+ | B | C | C+ | D | D+ | E | F | F+ | G | G+ | A' |
|---|---|---|---|---|---|---|---|---|---|---|---|---|---|
| Minor | 0 | | 2 | 3 | | 5 | | 7 | | 9 | | 11 | 0' |

-continued

| | A | A+ | B | C | C+ | D | D+ | E | F | F+ | G | G+ | A' |
|---|---|---|---|---|---|---|---|---|---|---|---|---|---|
| Scale Instrument Keys | A | | B | C | | D | | E | | F+ | | G+ | A' |

Example 2

Major Chord Instrument Keys, Tonic of C? keys where adjacently disposed keys within each complete scale exhibit a fixed mathematical relationship to

| | | C | C+ | D | D+ | E | F | F+ | G | G+ | A | A+ | B | C |
|---|---|---|---|---|---|---|---|---|---|---|---|---|---|---|
| Maj Chord | Maj | 0 | | | | 4 | | | 7 | | | | | 0' |
| Instrument Keys | | C | | | | E | | | G | | | | | C' |

More specifically, FIG. 1 shows a plan view of a musical instrument keyboard 10 having identically shaped and sized keys 11 arranged on a single plane 12. It is further noted that every key has the exact same shape and is of equal size making it easier as a result to access and play all keys/notes whether they are black 13 or white 14.

It is also apparent that it would be possible to extend the keyboard 10 to the right and/or to the left by adding any number of rows in order to obtain the desired overall range of musical notes.

As a human hand and fingers are positioned over the keyboard 10 both the black 13 and white 14 keys are equally accessible for play in more natural manner and for a greater number of musicians. There is no requirement for musicians to change their playing style as there would only be a minimal period of adjustment to get accustomed to the new keyboard.

In operation, a musical instrument, such as a piano for instance, is comprised of a keyboard 10 having a plurality of keys 11 connected to responsive means for enabling the generation of tones associated to said keys 11, respectively, the keys 11 being arranged in a parallel and fully adjacent manner relative to one another on a single plane 12. The tone generated by the keys 11 are substantially within the tonal range of a standard piano.

Other embodiments and uses of the invention will be apparent to those skilled in the art from consideration of the specification and practice of the invention disclosed herein. The specification and examples should be considered exemplary only and do not limit the intended scope of the invention.

I claim:

1. A musical instrument keyboard comprising:

a single row of keys comprising at least one complete scale of a plurality of complete scales for enabling generation of tones, each key having four sides when viewed from above, the keys for the at least one complete scale consisting of a predetermined sequence of adjacently disposed partially-black surfaced keys and white surfaced each neighboring key and the partially-black surfaced keys and white surfaced keys are identically sized and shaped, wherein each partially-black surfaced key has a bar-shaped surface that directly abuts and immediately extends from a first side of the partially-black surfaced key without contacting second, third, and fourth sides of the partially-black surfaced key, and wherein the first side is a top side of the partially-black surfaced key.

2. The musical keyboard according to claim 1, wherein the predetermined sequence is white, partially-black, white, partially-black, white, white, partially-black, white, partially-black, white, partially-black, and white.

3. The musical keyboard according to claim 1, wherein a position of fingers of a hand of a user do not change when playing a same basic pattern of uniquely defined solfege notes for different chords.

4. The musical keyboard according to claim 1, wherein the at least one complete scale of a plurality of complete scales comprises tones matching a predetermined portion of a tonal range of a standard piano.

5. The musical keyboard according to claim 1, wherein an overall tonal range of the keyboard is increased by adding further a predetermined portion of a further scale of the plurality of complete scales.

6. The musical keyboard according to claim 1, wherein the keys are generally rectangular in shape, and an edge of each key is directly adjacent to an edge of an adjacent key.

7. The musical keyboard according to claim 6, wherein the edge of each key is parallel to the edge of the adjacent key.

8. The musical keyboard according to claim 1, wherein the fixed mathematical relationship is two to the power of one twelfth.

9. The musical keyboard according to claim 1, wherein said partially black surfaces are centered laterally on a white surface of each partially black surfaced keys.

10. A musical instrument keyboard comprising:

a single row of keys comprising at least one complete scale of a plurality of complete scales for enabling generation of tones, each key having a pair of long sides and a pair of short sides when viewed from above, each short side having a dimension shorter than each long side, the keys for the at least one complete scale consisting of a predetermined sequence of adjacently disposed partially-black surfaced keys and white surfaced keys where adjacently disposed keys within each complete scale exhibit a fixed mathematical relationship to each neighboring key and the partially-black surfaced keys and white surfaced keys are identically sized and shaped, wherein each partially-black surfaced key has a black stripe directly abutting and immediately extending from one of the short sides, being parallel to the long sides, and having a length shorter than the long sides and a width shorter than the short sides, and wherein the short side from which the black stripe extends from is a top side of the partially-black surfaced key.

* * * * *